United States Patent [19]

Goldenstein

[11] 4,428,752

[45] Jan. 31, 1984

[54] HIGH BULK OLEFIN BLENDED YARN

[76] Inventor: Bertrand Goldenstein, 30 Cricket La., Great Neck, N.Y. 11024

[21] Appl. No.: 400,967

[22] Filed: Jul. 22, 1982

[51] Int. Cl.[3] ..... D02G 3/04; D06P 3/79; D06P 3/85; D06P 3/852

[52] U.S. Cl. ..... 8/529; 8/532; 8/533; 57/210; 57/224; 57/227; 428/362; 428/394; 428/400

[58] Field of Search ..... 57/210, 224, 227; 8/529, 532, 533; 428/362, 400, 394

[56] References Cited

U.S. PATENT DOCUMENTS

| | | | |
|---|---|---|---|
| 2,504,523 | 4/1950 | Harris et al. | 57/227 |
| 3,068,636 | 12/1962 | Masurel | 57/227 |
| 3,481,132 | 12/1969 | Bobkowicz et al. | 57/224 |
| 3,959,556 | 5/1976 | Morrison | 428/394 |
| 4,191,221 | 3/1980 | Boyer | 57/210 |
| 4,224,174 | 1/1980 | Bobkowicz | 57/224 |
| 4,225,442 | 9/1980 | Tremblog et al. | 57/224 |
| 4,263,777 | 4/1981 | Wada et al. | 57/227 |

*Primary Examiner*—James C. Cannon
*Attorney, Agent, or Firm*—Goodman & Teitelbaum

[57] ABSTRACT

A high bulk olefin blended yarn includes selected percentages by weight of olefin fiber with naturally occuring fiber such as cotton or wool, which are cut and blended together to form a staple thereof which are then spun and twisted in a conventional manner to form the blended yarn, the yarn becoming a high bulk yarn under controlled high heat levels. Preferably, 60% to 85% of cotton or wool by weight and 40% to 15% of olefin by weight are blended together. In a modified form, 20% to 40% by weight of polyester can replace a like amount of weight of the cotton or wool to reduce the cost thereof. The olefin in the fabric formed from the high bulk olefin blended yarn produces a wicking action capable of transmitting moisture from the wearer's body.

12 Claims, No Drawings

HIGH BULK OLEFIN BLENDED YARN

BACKGROUND OF THE INVENTION

The present invention is directed to a blended yarn, and more particularly to an olefin blended yarn to obtain a high bulk and at the same time provide a light weight yarn.

Olefin is a group of unsaturated hydrocarbons of the general formula $C_xH_{2n}$, being a manufactured fiber in which the fiber-forming substance is any long chain synthetic polyner composed of at least 85% by weight of ethylene, propylene, or other olefin units.

Olefin is well known in the textile art, but has had limited use because of its low melting point and its inability to retain a constant dye color over a period of time when piece dyed. Accordingly, the olefin is usually dyed during the formation of the filament.

U.S. Pat. No. 3,295,308 discloses the manufacture of multifilament polyolefin carpets madeup of filaments, particularly polypropylene multifilaments, having a predetermined cross-section wherein the yarn in the carpet has sufficient flexibility for good processing and yet also has increased cover, bulk and stiffness and other improved properties.

In the textile art, it is desired in many cases to produce yarn which possesses a high bulk. U.S. Pat. No. 3,587,220 teaches that the finishing treatments of yarns or fabrics may be used to bring about the shrinkage of the shrinkable fiber components therein for the development of bulk. This patent relates to woven or knitted fabrics which include melt colored polyester staple fibers and polyester staple fibers of high shrinkage in their construction. Particularly, the woven or knitted fabrics comprise 65–90% by weight of polyester staple fibers of which 15–40% expressed on weight of the fabric are fibers having a shrinkage of at least 25%, and 75–25% by weight are polyester fibers of normal shrinkage, at least some of either kind of polyester fibers being melt colored polyester fibers, and 35–10% expressed on the weight of the fabric of wool or cellulosic fibers. Shrinkage of the colored fibers cause a lightening of the fabric color because of the concentration of these fibers within the yarn. The polyester fiber can be a polyethylene terephthalate.

Normally, if a high bulk yarn is desired, the twist would be lowered, however, the strength would be sacrificed. U.S. Pat. No. 3,371,475 discloses a spun yarn having a low twist multiplier including blends of polyethylene terephthalate with minor portions of rayon and with minor portions of cotton so that the yarn possesses a high bulk and covering power with a good degree of strength. Particularly, the measured stapled length is from 2.25 to 3.0 inches and the fiber denier is less than 2.0, so that the normal yarn twist multiplier of 3.5 to 4.0 can be drastically reduced to a value below 2.0 to produce bulky polyethylene terephthalate yarn which maintains a surprisingly degree of strength, the twist multiplier preferably being from 1.65 to 1.85.

Naturally occuring fibers, such as cotton fibers have been treated with various antimicrobial agents to inhibit the growth of bacteria and fungus. U.S. Pat. No. 3,959,556 discloses antimocrobial blended yarns and fabrics comprised of naturally occuring fibers wherein the antimicrobial properties are imparted to the naturally occuring fibers by intimately admixing the naturally occuring fibers with synthetic fibers. The synthetic fibers, which include polyolefins, particularly polypropylene and polyethylene, contain at least 0.1% by weight of the antimicrobial agent wherein the resultant filaments are chopped into short fiber lengths and blended with naturally occuring fibers, such as cotton and flax or wool, at any stage of the yarn forming process according to known techniques. This yarn may be used in the formation of fabrics and garments by weaving, knitting or the like.

U.S. Pat. No. 3,524,542 discloses a heat sealable bonding cord which will retain substantial amounts of elongation resistance during heat sealing operations in the wrapping of packages. The bonding cord is composed of blends of thermoplastic and non-thermoplastic material wherein the thermoplastic materials include polypropylene and polyester, and the non-thermoplastic materials include cotton, rayon, siliceous fibers or wool.

U.S. Pat. No. 3,007,227 discloses a stretchable fabric having elastic properties without resorting to the use of any natural rubber in the fabric. The stretchable fabric is a blend of intermingled fibers including a hard inelastic staple fiber and an elastomeric staple fiber, and is formed by the spinning of these blends into a textile material. The hard inelastic staple fiber may be prepared from any synthetic fiber-forming materials or from any natural fiber, such ascotton, wool, silk, jute, linen or a blend of two or more hard fibers.

Even though the above patents disclose the use of polyolefin, the production of yarn which possesses a high bulk, and blends all naturally occuring fibers such as cotton with synthetic fibers, none of the above patents teach or disclose a blend of olefin with a naturally occuring fiber such as cotton which becomes a high bulk yarn under controlled high heat levels.

SUMMARY OF THE INVENTION

Accordingly, it is an object of the present invention to provide a high bulk olefin blended yarn which is an improvement over the prior art yarns.

Another object of the present invention is to blend an untextured olefin fiber with a naturally occuring fiber such as cotton, and then spinning the blended fibers into yarn to provide a high bulk yarn under controlled high heat levels.

A further object of the present invention is to provide a high bulk olefin blended yarn as described above which has all the comfort features of cotton.

Still another object of the present invention is to provide a high bulk olefin blended yarn which can be formed into a fabric capable of being piece dyed.

Another object of the present invention is to provide a high bulk olefin blended yarn which can be formed into a fabric capable of being ironed in a conventional manner.

An added object of the present invention is to provide a fabric formed from a high bulk olefin blended yarn which would be light in weight, which would cost less than a fabric formed entirely of cotton with the same bulk level, and which could be knitted with a reduced amount of cotton dust created therefrom during the knitting thereof.

And yet another object of the present invention is to provide a fabric formed from a high bulk olefin blended yarn which would transmit moisture from the body of a wearer thereof.

In accordance with the above objects, the present invention includes the selected percentages by weight of olefin fiber with naturally occuring fiber such as cotton, which are cut and blended together to form a staple thereof which are then spun and twisted in a conventional manner to form a blended yarn, the yarn becoming a high bulk yarn under controlled high heat levels. Preferably, 60% to 85% of cotton by weight and 40% to 15% of olefin by weight are blended together. In a modified form, 20% to 40% by weight of polyester can replace a like amount of weight of the cotton to reduce the cost thereof. The olefin in the fabric formed from the high bulk olefin blended yarn produces a wicking action capable of transmitting moisture from the wearer's body.

DETAILED DESCRIPTION OF THE PREFERRED EMBODIMENT

Naturally occuring fibers, such as cellulose fibers, for example cotton and flax; wool; and like fibers possess high moisture absorption properties which are not found in synthetic fibers. For this reason, these naturally occuring fibers, particularly cotton fibers, are commonly used for the manufacture of articles of clothing, bedding, and the like, particularly those articles which come into contact with the human body. However, the cost of these naturally occuring fibers is quite high, and sometimes prohibitive. Accordingly, the present day trend is to blend these naturally occuring fibers with synthetic fibers to reduce the cost thereof. Additionally, these naturally occuring fibers, particularly cotton fibers, produce a yarn which is basically considered a "dead" yarn which can hardly be considered a bulk yarn.

According to the present invention, olefin fibers have been blended with the naturally occuring fibers, such as cotton fibers, to reduce the cost of the article being manufactured, and to provide a high bulk blended yarn. It has been found, that when two different fibers are blended, it is almost always true that the fiber present in the larger proportion will impart to the blended yarn or fabric the physical properties characteristic of this particular fiber, whereas the physical properties inherent in the fiber present in lesser proportion will be so masked or diluted that the latter properties will not be apparent in the yarn or fabric.

As stated above, olefin has a low melting point, at approximately 330° to 340° F. Therefore, yarns or fabrics formed entirely from olefin cannot be ironed in a conventional manner which would cause the yarn or fabric to melt. Olefin first becomes soft at approximately 280° to 300° F., whereby shrinkage thereof starts at a lower temperature. At about 165° F. the olefin will shrink approximately 4 to 8%, and at about 212° F. the olefin will shrink approximately 10 to 15%. This shrinkage causes a bulking effect. It is noted, that the olefin will decompose at approximately 550° F. Therefore, the highest recommended temperature for a fabric formed entirely from olefin is approximately 250° F., wherein the mill processing of the olefin is usually at approximately 220° F.

Furthermore, the fabrics formed entirely from olefin are not piece dyed because the olefin will not retain a constant dye color over a period of time. Therefore, the olefin is usually dyed during the formation of the filament.

On the other hand, olefin has a low specific gravity, and is therefore light in weight. Additionally, when olefin is formed into a fabric, even though the olefin yarn has very little absorbency, the olefin provides a wicking action to transmit the body moisture of the wearer to the outside of the garment, which is not capable with a polyester fabric. It should be noted, that a fabric formed entirely of non-textured olefin does not have a high bulk.

Therefore, the blending of cotton and olefin fibers to form a yarn according to the present invention is desirous to reduce the cost thereof, and also provides an unexpected result of obtaining a high bulk yarn, wherein both of these fibers when taken alone do not produce a high bulk yarn.

Selected percentages of the naturally occuring fiber, preferably cotton fiber, and the olefin fiber are cut and blended together in a conventional manner well known in the textile art to form a staple thereof, which are then spun and twisted in a conventional manner, also well known in the textile art, to form the blended yarn. Under controlled high heat levels at selected degrees of temperature, the blended yarn blooms or becomes a high bulk yarn. The fabric formed from this high bulk yarn is light in weight and costs less than a fabric formed entirely of cotton with the same bulk level. Unlike the well known cotton and polyester blended fabrics, the cotton and olefin blended fabric transmits moisture from the wearer's body through the olefin wicking action.

The wicking action of the olefin causes moisture deposited on one surface of the cotton and olefin blended fabric to be transmitted to the opposite surface of the blended fabric. Thus, this wicking action results in the wearer not experiencing a sweating or clammy feeling when wearing a garment containing the blended fabric of the present invention. Additionally, if the blended fabric is used in bedsheets, and more particularly in hospital bedsheets, the wicking action of the olefin portion of the blended fabric substantially reduces the moisture between the user and the bedsheet, and therefore increases the comfort of the user. In hospital bedsheeting, this wicking action would substantially reduce one of the prime causes of bed sores and irritations.

It has been noted, that the olefin fibers during the spinning process tend to migrate to the core of the yarn due to its above mentioned low specific gravity. Furthermore, under controlled high heat, the olefin fibers have an added tendency to migrate even further to the core of the yarn or the fabric, so that the wearer or user thereof experiences all the attributes of the cotton fiber disposed on the outside of the blended yarn, in addition to all of the attributes added by the olefin fiber itself, without any of the negative effects. Thus the cotton and ofefin blended yarn provides all the comfort features of cotton, being enhanced by the wicking action of the olefin. It is further noted, that the synthetic touch or feel of the olefin fiber is not felt by the wearer or user of the blended fabric, whereby the user or wearer only feels the comfort of the cotton, such as in the articles of clothing, bedsheets and the like.

The above mentioned migrations of the olefin to the core of the yarn provides additional advantages to the blended yarn or fabrics formed therefrom. Accordingly, it is possible to piece dye the blended yarn or the fabric formed therefrom even though it contains olefin fibers, wherein the fabric itself could be bulked with the application of heat.

Additionally, the fabric formed from the blended yarn would have a high melting point so that the fabric can be ironed in a conventional manner, where in many cases the iron would only contact the cotton and would not contact the olefin which has migrated to the core of the yarn or the fabric. Thus, the ironing of the blended fabric can be carried out in a normal manner due to the isolating effect of the cotton to the outside of the blended yarn. Such ironing would not be possible in a 100% olefin garment, which would melt under high heat conditions.

In the blended yarn of the present invention, fusing between the olefin and the cotton occurs at approximately 350° F. Accordingly, the recommended maximum temperature for the blended yarn is approximately 330° F., however, 320° F. is preferred. It is noted, that this 320° F. preferred maximum for the blended yarn of the present invention is considerably higher than the recommended maximum temperature of 250° F. for an olefin fabric, as set forth above.

The following table shows the bulking action under selected high heat conditions, whereby each sample of the blended yarn was achieved at first drawing with a cotton system processing of the second drawing, and with roving and spinning being a normal cotton system with a twist multiple of 3.0.

| | | | Percentage of Bulking Under Selected Heat Conditions | | | |
|---|---|---|---|---|---|---|
| Yarn Size | % by wt. cotton | % by wt. olefin | 250° F. | 275° F. | 300° F. | 320° F. |
| 18/1 | 80 | 20 | 2.4% | 3.5% | 8.5% | 17.8% |
| 28/1 | 80 | 20 | 2.1% | 3.7% | 7.0% | 12.7% |
| 18/1 | 65 | 35 | 2.9% | 5.6% | 8.8% | 22.2% |
| 28/1 | 65 | 35 | 2.9% | 4.7% | 10.5% | 21.4% |

It is noted from the above table, that the bulking action of the blended yarn is progressive with the temperature elevation, and is only limited by the plasticizing or melting of the olefin fibers in the blended yarn, which occurs at approximately 350° F. as mentioned above.

Preferably, 60% to 85% of cotton by weight and 40% to 15% of olefin by weight are blended together, wherein the exact ratio of cotton to olefin would be decided by the bulking action desired and by the use to which the fabric is to be put, which would also include the cost factors in connection therewith. Accordingly, the unexpected blooming or transforming of a "dead" yarn into a high bulk yarn under controlled high heat levels has many advantages from a fashion and a comfort point of view.

It is further noted, that the application of heat and the accompanying bulking of the blended yarn appears to lessen the amount of cotton dust which is normally created in the knitting of a fabric. Accordingly, this would make knitting of cotton olefin blends possible in situations where the knitting of 100% cotton or cotton polyester blends are not possible.

In a modified form, 20% to 40% by weight of polyester staple fibers can replace a like amount by weight, of the cotton to reduce the cost thereof.

In a further modified form, the naturally occuring fiber could be wool, wherein the above mentioned features would also apply to a wool and olefin blend, or a wool, polyester and olefin blend.

Numerous alterations of the structure and process herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A blended yarn comprising selected percentages by weight of naturally occuring staple fibers and synthetic staple fibers, both said staple fibers separately having a low bulk, said synthetic staple fibers having a lower specific gravity than said naturally occuring staple fibers, said naturally occuring staple fibers having a high moisture absorption property and said synthetic staple fibers having a low moisture absorption property, said synthetic staple fibers being shrunk and providing bulk to said yarn, said synthetic staple fibers being mainly disposed at said yarn's core, said synthetic staple fibers providing a wicking action to transmit moisture from one side of said yarn to an opposite side of said yarn, said synthetic staple fibers being olefin, whereby said blended yarn includes all the comfort features of cotton enhanced by said wicking action of said olefin and the bulking of said yarn, and a fabric formed from said blended yarn can be ironed in a conventional manner.

2. A blended yarn according to claim 1, wherein said selected percentages by weight of said olefin are 40% to 15%.

3. A blended yarn according to claim 2, wherein said yarn is piece dyed.

4. A blended yarn according to claim 2, wherein said selected percentages by weight of said naturally occuring staple fibers are 60% to 85%.

5. A blended yarn according to claim 4, wherein said naturally occuring staple fibers are cotton or wool.

6. A blended yarn according to claim 4, wherein said naturally occuring staple fibers are cotton.

7. A blended yarn according to claim 6, wherein said yarn is piece dyed.

8. A blended yarn according to claim 6, wherein said yarn has a 2.1% to 22.2% of bulking under heat conditions of 250° F. to 320° F., said bulking being proportional to the heating temperatures.

9. A blended yarn according to claim 2, wherein said yarn further includes a selected percentage by weight of polyester staple fibers.

10. A blended yarn according to claim 9, wherein said selected percentages by weight of said naturally occuring staple fibers combined with said polyester staple fibers are 60% to 85% with said polyester staple fibers alone being 20% to 40%.

11. A blended yarn according to claim 10, wherein said naturally occuring staple fibers are cotton or wool.

12. A blended yarn according to claim 10, wherein said naturally occuring staple fibers are cotton.

* * * * *